US007861467B2

(12) United States Patent
Rosten et al.

(10) Patent No.: US 7,861,467 B2
(45) Date of Patent: Jan. 4, 2011

(54) BAFFLE VENT FOR MANUFACTURED HOUSING

(75) Inventors: David B. Rosten, Isanti, MN (US); David J. Bonanni, Fleetwood, PA (US); Richard Pirino, Wyomissing, PA (US)

(73) Assignee: Brentwood Industries, Inc., Reading, PA (US)

( * ) Notice: Subject to any disclaimer, the term of this patent is extended or adjusted under 35 U.S.C. 154(b) by 85 days.

(21) Appl. No.: 12/040,549

(22) Filed: Feb. 29, 2008

(65) Prior Publication Data

US 2008/0209822 A1 Sep. 4, 2008

Related U.S. Application Data

(60) Provisional application No. 60/904,280, filed on Mar. 1, 2007.

(51) Int. Cl.
*E04B 7/00* (2006.01)
*E04H 12/28* (2006.01)
*E04D 3/40* (2006.01)

(52) U.S. Cl. ..... 52/95; 52/198; 52/199

(58) Field of Classification Search ..... 52/95, 52/198, 199

See application file for complete search history.

(56) References Cited

U.S. PATENT DOCUMENTS 4,096,790 A * 6/1978 Curran ..... 454/260
4,197,683 A * 4/1980 Ward ..... 52/95
4,406,095 A * 9/1983 Slavik ..... 52/95
4,446,661 A * 5/1984 Jonsson et al. ..... 52/95
4,977,714 A * 12/1990 Gregory, Jr. ..... 52/95
5,341,612 A 8/1994 Robbins ..... 52/95
5,596,847 A * 1/1997 Stephenson ..... 52/198
5,600,928 A * 2/1997 Hess et al. ..... 52/309.4
6,061,973 A * 5/2000 Accardi et al. ..... 52/90.1
7,094,145 B2 8/2006 Rye ..... 454/366
7,302,776 B2 * 12/2007 Duncan et al. ..... 52/95
2008/0209822 A1 * 9/2008 Rosten et al. ..... 52/90.1
2008/0216419 A1 * 9/2008 Rosten et al. ..... 52/95

* cited by examiner

*Primary Examiner*—Richard E Chilcot, Jr.
*Assistant Examiner*—Andrew J Triggs
(74) *Attorney, Agent, or Firm*—Miller Law Group, PLLC

(57) ABSTRACT

A baffle vent is formed to span several roof rafters in a panel form with alternating flat ribs and rounded valleys extending along the longitudinal length thereof. The spacing of the flat ribs is four inches on center so that the transverse width of the panel will be engaged properly with roof rafters spaced on a multiple of four inches. The baffle vent includes uniformly spaced transverse ribs that extend from one transverse edge of the panel to the other to stiffen the panel which is formed of vacuum molded polyvinyl chloride film. The baffle panel is placed on top of the roof rafters before the roof sheeting is applied so that the insulation will force the baffle vent against the roof where the flat ribs engage the roof sheeting and the rounded valleys provide a passage for air to flow from the building soffit to the roof vent.

20 Claims, 5 Drawing Sheets

Fig. 1
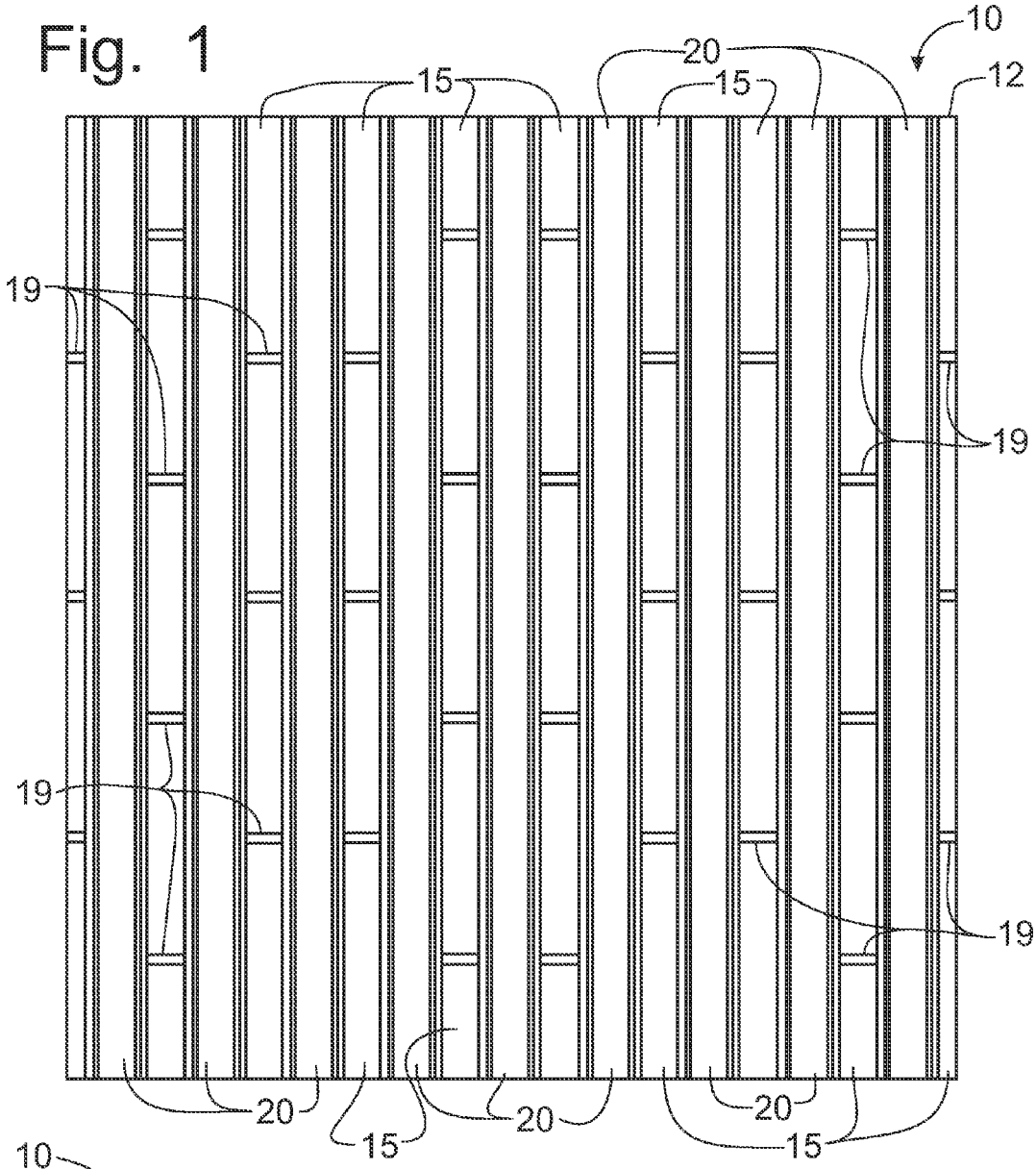
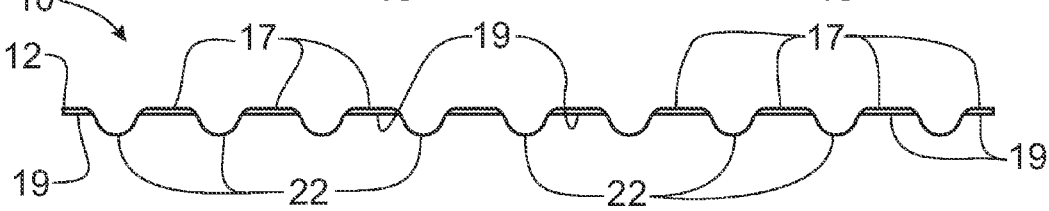
Fig. 2

Fig. 8
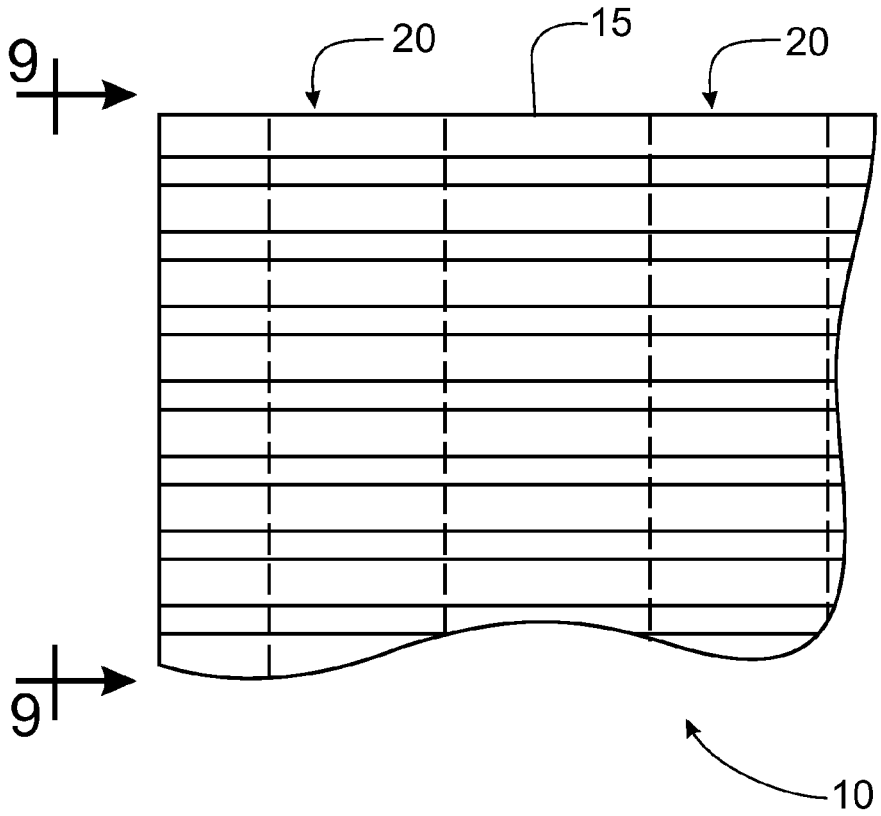
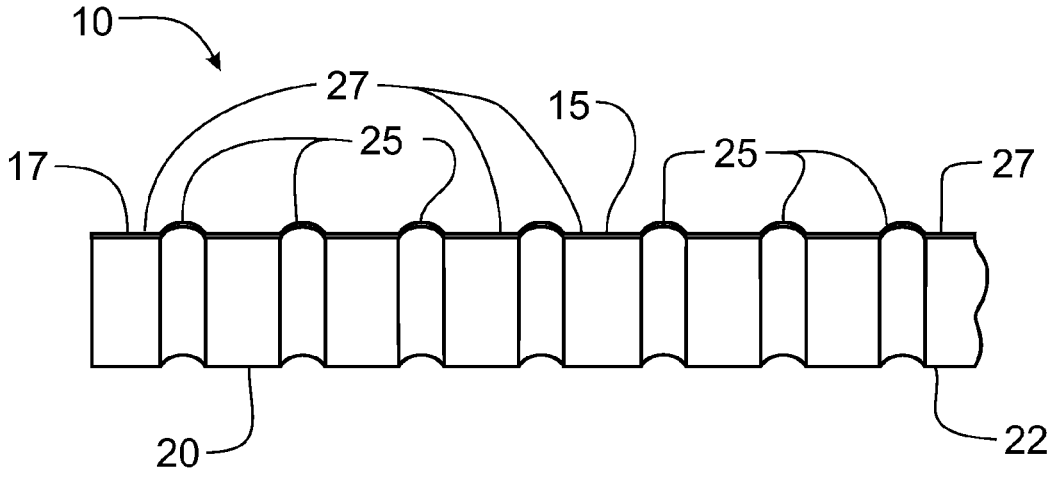
Fig. 9

BAFFLE VENT FOR MANUFACTURED HOUSING

CROSS-REFERENCE TO RELATED APPLICATIONS

This application claims domestic priority on U.S. Provisional Patent Application Ser. No. 60/904,280, filed on Mar. 1, 2007, the contents of which are incorporated herein by reference.

FIELD OF THE INVENTION

This invention relates generally to attic vent baffles commonly used in residential building structures to allow ventilation flow from soffit vents into an attic space for venting from the attic, and, more particularly to a baffle vent that can be used in the manufacturing housing industry.

BACKGROUND OF THE INVENTION

Attic ventilation systems are typically used in residential buildings to provide proper ventilation of the attic space, which is desired to help prevent formation of condensation along the interior surface of the roof. Condensation can damage the attic insulation and the wooden structure of the building itself. Proper ventilation also helps to prevent premature melting of snow accumulated on a building roof, which can lead to the formation of ice on the roof that presents a safety hazard and can also lead to roof damage. Such attic ventilation systems will utilize vents placed into the underside of the soffit, which projects outwardly from the roof of the building and forms the overhang at the perimeter of the building roof. The intent of these attic ventilation systems is for air to travel through the soffit vents into the attic space and be discharged through an attic vent, which is typically placed at the apex of the roof.

The use of insulation in the attic to provide a barrier to the transmission of heat between the occupied portion of the building structure and the unoccupied attic portion of the building can restrict, or even prevent, the flow of air from the soffits to the roof vent at the apex of the roof. The insulation can be packed along the joists of the roof trusses to the soffits and not allow a passageway for the movement of air past the insulation into the portion of the attic above the insulation. Known construction of the insulation material can include cellulose, rock wool, fiberglass and expanded foam, the latter being used most often in manufactured housing, i.e. housing constructed in a factory and transported to the job site instead of being constructed at the job site. To maintain a discrete passageway for the movement of from the soffit, past the insulation barrier, and into the upper portion of the attic for discharge through the roof vent, baffle vents have been provided for attachment to the interior side of the roof to keep the insulation separated from the interior surface of the roof deck.

One embodiment of a baffle vent can be seen in U.S. Pat. No. 7,094,145, granted on Aug. 22, 2006, to Palle Rye, et al, and assigned to Brentwood Industries, Inc. The Rye baffle vent is stapled to the interior surface of the roof sheeting between the roof rafters and includes a tail portion that is bent in the vicinity of the soffit to extend from the interior surface of the roof sheeting to engage the wall plate. This baffle vent thus forms a barrier that prevents the movement of insulation into the soffit area and restricting the flow of air from the soffit into the attic. The structure of the baffle vent incorporates a series of convolution that are oriented parallel to the roof rafters to provide channels that define passageways for the movement of air past the insulation that is engaged against the baffle vent. In operation, the baffle vent utilizes the channels to keep the insulation away from the interior surface of the roof and establishes dedicated passages for the flow of air past the insulation along the interior surface of the roof sheeting.

Earlier configurations of baffle vents can be seen in U.S. Pat. No. 4,446,661, granted to Jan Jonsson, et al, on May 8, 1984, in which a corrugated sheet is fastened to the vertical surfaces of adjacent roof rafters to provide a plurality of longitudinally extending passageways for the movement of air past insulation in the roof. A major consideration in the design and manufacture of such baffle vents is the cost of such structures, particularly when taking into consideration the large square footage of the roofs of some residential buildings. Consequently, baffle vents have been fabricated extensively of foam or plastic material in narrow sheets that form self-supporting structures that can be handled and manipulated into position between the roof rafters for attachment against the interior surface of the roof sheeting. In U.S. Pat. No. 5,341,612, issued to Gary Robbins on Aug. 30, 1994, a baffle vent structure is formed of a thinner foam sheet material and includes a reinforced structure to prevent the vents from collapsing during shipping, handling and installation, as well as to prevent collapsing of the vents from compacted insulation which often is blown into attic areas of a building against the underside of the baffle vents.

Conventional residential construction affected at the job site will typically have the roof structure formed at the same time as the exterior shell of the building so as to get the building under roof to prevent the intrusion of foul weather into the interior of the building. The baffle vents described above are intended for use in such on-site construction techniques. Since the insulation is placed into the attic area long after the roof sheeting and shingles are added to the roof rafters, the baffle vents are formed to be placed between the roof rafters on the underside of the roof sheeting by attaching mounting flanged to either the vertical surfaces of the roof rafters, as is depicted in the aforementioned U.S. Pat. No. 4,446,661 to Jonsson, or the underside of the roof sheeting, as is depicted in U.S. Pat. No. 5,341,612 to Robbins. Generally, the baffle vents are installed as part of the installation of the insulation by contractors that specialize in the installation of insulation, rather than by the roofing contractor that will install the roof vent at the apex of the roof structure.

Manufactured housing is constructed in a factory setting where there is no pressing need to have the roof structure completed before the interior portions of the house are completed. As a result, the baffle vents can be installed on top of the roof rafters before the roof sheeting is fastened to the roof rafters. Generally, manufactured housing is formed with the interior drywall sheeting applied to the bottom side of the ceiling joists to form the inside ceiling of the housing before the roof is completed. The roof sheeting is then attached to the top surfaces of the roof rafters, followed by the application of the exterior roofing materials, typically fiberglass shingles. Insulation can then be installed between the joists on top of the drywall. While blanket fiberglass insulation or blown loose cellulose or fiberglass insulation can be used, expanded foam is often used in manufactured housing construction. The expansion rate of the foam places a substantial pressure on the baffle vent and will often collapse the passageways, resulting in the interruption of the air flow from the soffit past the insulation layer.

An example of a baffle vent that is adapted for use in the manufactured housing setting can be found in U.S. Pat. No. 5,596,847, granted to Michael Stephenson on Jan. 28, 1997. This baffle vent is formed with longitudinally extending ribs that are spaced on eight inch centers so that the single panel can be used on rafters whether spaced sixteen or twenty-four inches apart. A score line is formed on one of the interior ribs so that the excess eight inch strip can be removed if the baffle vent is used on rafters spaced at sixteen inched. In U.S. Pat. No. 4,096,790, issued on Jun. 27, 1978, to Laurence Curran, the baffle vent is formed to span across multiple roof rafters with a panel hanging down to engaged the wall plate and form a barrier to restrict the passage of insulation into the soffit area. In the Curran baffle vent configuration, mounting ribs are spaced at intervals corresponding to the roof rafter structure on which the baffle vent is to be applied. Thus, to be used with sixteen inch and twenty-four inch rafter spacings, the Curran baffle vent would have to be provided in two different models.

The Stephenson baffle vent configuration, and particularly in the Curran baffle vent configuration, the spacing of the longitudinally extending ribs provides a wide span between the ribs to define large passageways for the movement of air along the interior surface of the roof sheeting. Unfortunately, this wide expanse of unreinforced passageway, particularly when the baffle vent is manufactured from foam or a thin plastic material to maintain cost considerations, is subjected to collapse, especially when used with expanding foam insulation techniques. If the passageway collapses, the baffle vent is not functional to allow the passage of air from the soffit past the insulation layer to the upper portions of the attic structure.

Accordingly, it would be desirable to provide a baffle vent structure that would be particularly adapted for use in the manufactured housing industry to establish and maintain passageways for the movement of air from the building soffit past the insulation layer into the upper attic area for discharge from the attic through a roof vent. It would also be desirable that the baffle vent be formed in a manner to resist a collapsing of the air flow passageways when expanded foam insulation material, or other similar insulation material that exerts a force onto the baffle vent, is installed against the baffle vent.

SUMMARY OF THE INVENTION

It is an object of this invention to overcome the disadvantages of the prior art by providing a baffle vent that is designed for use in manufactured housing.

It is another object of this invention to provide a baffle vent that will mount on top of the roof rafters in a manufactured house.

It is a feature of this invention that the placement of the roof sheeting on top of the roof rafters will hold the baffle vent in place.

It is an advantage of this invention that the baffle vent is placed on the roof rafters before the roof sheeting is placed on the rafters.

It is another feature of this invention that the baffle vent is formed with alternating flat ribs and rounded valleys spaced along the transverse width of the baffle vent.

It is another advantage of this invention that the flat ribs are sized to seat on top of a standard roof rafter.

It is still another advantage of this invention that the flat ribs are formed on four inch spacing so that the flat ribs will be properly seated on a roof rafter whenever the roof rafters are located at a spacing that is a multiple of four.

It is still another feature of this invention that the transverse width of the baffle vent overlaps at least three rafters.

It is yet another feature of this invention that the flat ribs are formed with transverse relief depressions to interconnect adjacent valleys.

It is yet another advantage of this invention that the transverse relief depressions formed in the flat ribs allows the drainage of moisture that collects between the roof sheeting and the baffle vent.

It is a further advantage of this invention that the transverse relief depressions formed in the flat ribs allow for air flow between adjacent valleys.

It is a further feature of this invention that each flat rib is formed with a plurality of transverse relief depressions spaced along the longitudinal length of the flat rib.

It is still another object of this invention to provide a baffle vent structure that can be formed in widths that will span across several roof rafters with a sufficiently rigid configuration that will be easily deployed.

It is another feature of this invention that the baffle vent is formed with transversely extending ribs that extend from one transverse edge of the baffle vent to the other transverse edge.

It is still another feature of this invention that the transverse ribs project upwardly from the longitudinal flat ribs for engagement with the roof sheeting.

If is yet another feature of this invention that the transverse ribs are spaced along the entire longitudinal length of the baffle vent.

It is another advantage of this invention that the transverse ribs stiffen the baffle vent to make the baffle vent easier to deploy in sheet form to the roof rafters during the manufacturing process of manufactured housing.

It is still another advantage of this invention that the transverse ribs are uniformly spaced along the longitudinal length of the baffle vent to define gaps along the top of the flat ribs for the drainage of moisture to adjacent valleys.

It is yet another advantage of this invention that the gaps between the uniformly spaced transverse ribs also allow the passage of air between adjacent valleys.

It is a further feature of this invention that the transverse ribs extend uniformly along the entire transverse width of the baffle vent from one transverse edge to the other.

It is a further advantage of this invention that the extension of the transverse ribs from edge to edge on the baffle vent provides adequate stiffness to the baffle vent for ease of deployment in a manufactured house operation.

It is still a further feature of this invention that the valleys are rounded along the longitudinally extending trough thereof to resist collapse when encountering the forces associated with the installation of insulation.

It is still a further advantage of this invention that the rounded valleys are sufficient to resist the forces associated with the installation of expanded foam insulation in the construction of manufactured housing.

It is yet a further advantage of this invention that the longitudinally extending flat ribs between adjacent rafters engage the roof sheeting to help the adjacent valleys to resist the forces associated with the installation of insulation in a manufactured housing setting.

It is yet another object of this invention to provide a baffle vent for use in manufactured housing, which is durable in construction, inexpensive of manufacture, carefree of maintenance, facile in assemblage, and simple and effective in use.

These and other objects, features and advantages are accomplished according to the instant invention by providing a baffle vent having a transverse width that will span several roof rafters. The baffle vent is formed in a panel with alternating flat ribs and rounded valleys extending along the longitudinal length thereof. The spacing of the flat ribs is four inches on center so that the transverse width of the panel will be engaged properly with roof rafters spaced on a multiple of four inches. The baffle vent includes uniformly spaced transverse ribs that extend from one transverse edge of the panel to the other to stiffen the panel which is formed of vacuum molded polyvinyl chloride film. The baffle panel is placed on top of the roof rafters before the roof sheeting is applied so that the insulation will force the baffle vent against the roof where the flat ribs engage the roof sheeting and the rounded valleys provide a passage for air to flow from the building soffit to the roof vent.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a top plan view of a portion of the baffle vent incorporating the principles of the instant invention, the depicted baffle vent corresponding to a first stamping of the larger full sized baffle vent vacuum molded during the manufacturing process;

FIG. 2 is an end elevational view of the baffle vent segment depicted in FIG. 1 and being arranged as an orthogonal projection of FIG. 1;

FIG. 8 is a partial top plan view of an alternative ribbed configuration of the baffle vent; and FIG. 9 is an enlarged partial side elevational view of the baffle vent depicted in FIG. 8.

DETAILED DESCRIPTION OF THE PREFERRED EMBODIMENT

Referring to FIGS. 1-7, a baffle vent incorporating the principles of the instant invention can best be seen. The baffle vent 10 is preferably formed from polyvinyl chloride (PVC) film (not shown) having a thickness of about 12 to 16 mils through a conventional vacuum molding process in which the film is placed over a mold (not shown) and heated. A vacuum applied to the film draws the PVC film over a mold to cause the PVC film to assume the shape of the mold. In the preferred embodiment, the mold would have dimensions of about 39 inches by about 36 inches. Since the PVC film is supplied from a continuous roll, the baffle vent 10 can be formed in sequential segments 12, which are then severed along the center of a rib 15, as will be described in greater detail below, to form the complete baffle vent 10.

Figure 3:
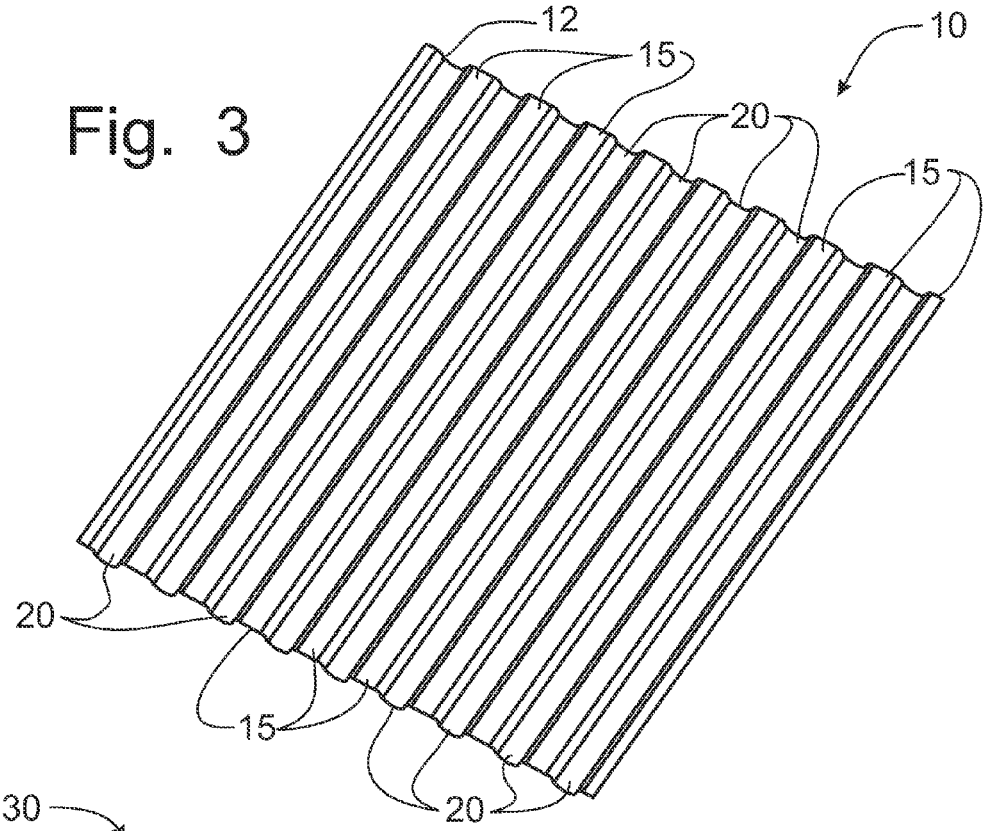
FIG. 3 is a perspective view of the baffle vent segment depicted in FIG. 1.
Figure 4:
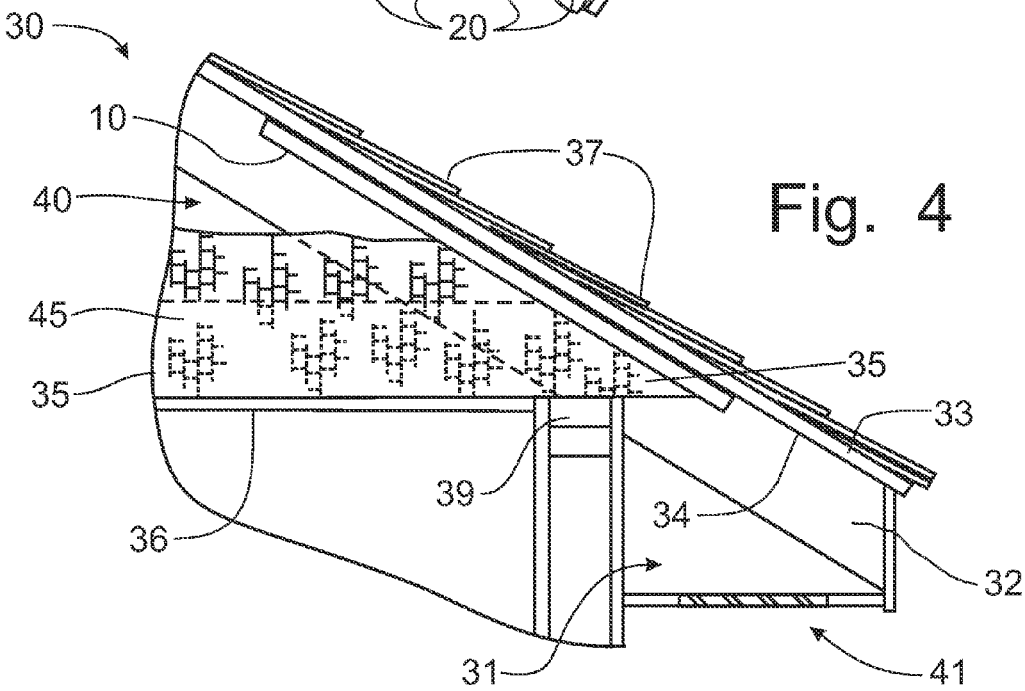
FIG. 4 is a partial schematic cross-sectional view depicting an elevational view of a representative manufactured housing structure utilizing a baffle vent according to the principles of the instant invention.
Figure 5:
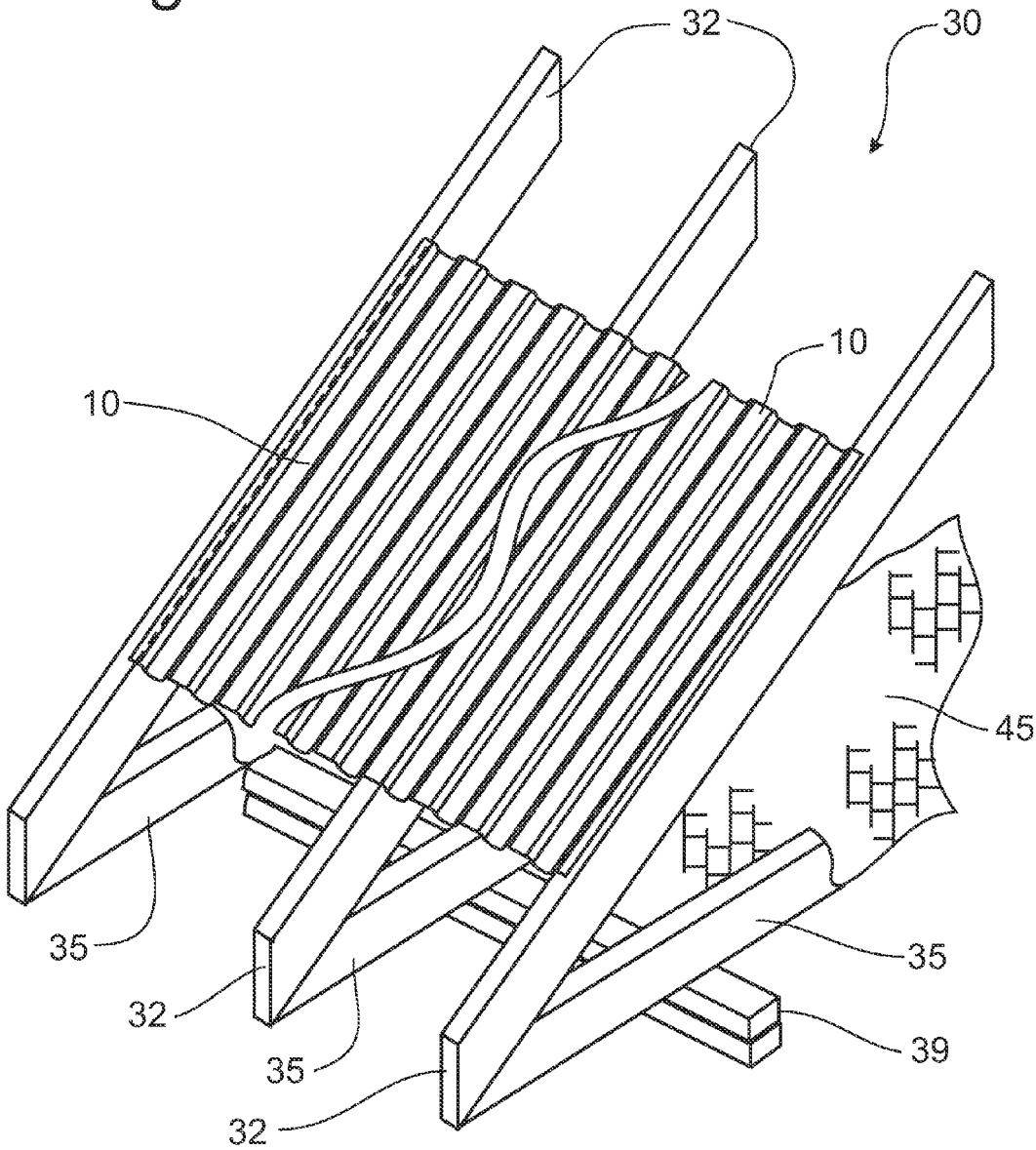
FIG. 5 is a partial perspective view of a baffle vent mounted on the rafters of a roof structure according to the principles of the instant invention.

A single segment 12 is depicted in FIGS. 1-3. The preferred dimensions of the completed baffle vent 10 are about 39 inches high by 96 inches (8 feet) wide. The formation of such a baffle vent 10 would require the molded film to be severed after the third sequential segment, to form the baffle vent 10 at a temporary width of 9 feet. A 12 inch strip would then be cut off the baffle vent to provide the final 8 foot width dimension. The removed strip would then be recycled. Alternatively, the baffle vent could be formed at a 12 foot width which would correspond to four sequential segments before being severed without any waste to be recycled. Research has shown, however, that the 8 foot width is preferred in use because of the handling requirements and associated difficulties of transporting and installing the larger 12 foot wide baffle vent 10. One skilled in the art will recognize that the size of the mold will depend on the physical parameters of the machinery operating the mold. Accordingly, other segment sizes are within the scope of the invention. For example, the width of the baffle vent 10 could be 10 feet so that a fifty foot long structure could be covered by five baffle vents mounted end to end. With the thickness of the material being at about 12 mils, the baffle vent 10 can be easily trimmed at the last rafter or simply overlapped.

As can be seen in the drawings, the baffle vent 10 is formed with a series of parallel, longitudinally extending ribs 15 separated by a valley 20 defining an overall depth of the baffle vent 10. The ribs 15 are spaced at four inch centers to provide the ability to be mounted on either sixteen or twenty-four inch roof rafter 32 spacings. With an eight foot width, the baffle vent 10 would span across seven roof rafters 32 placed at sixteen inch centers, and five roof rafters 32 placed at twenty-four inch centers, with the lateral edges 13 of the baffle vent being mounted on two end rafters 32 and either five or three intermediate roof rafters 32, depending on the spacing.

Figure 6:
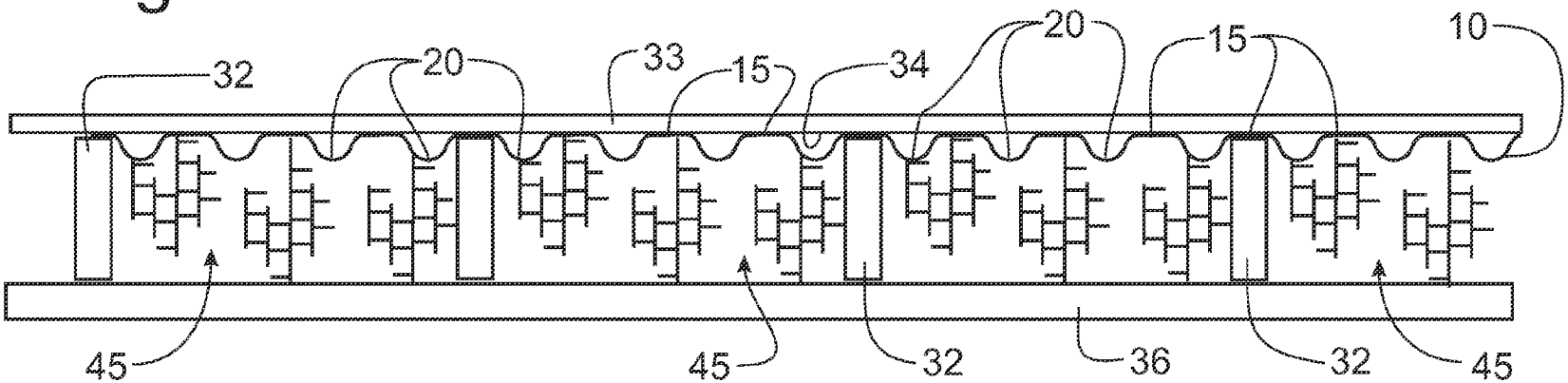
FIG. 6 is an end elevational view of a portion of baffle vent depicted in FIG. 5 at the wall plate, looking in the orientation of the installed baffle vent.
Figure 7:
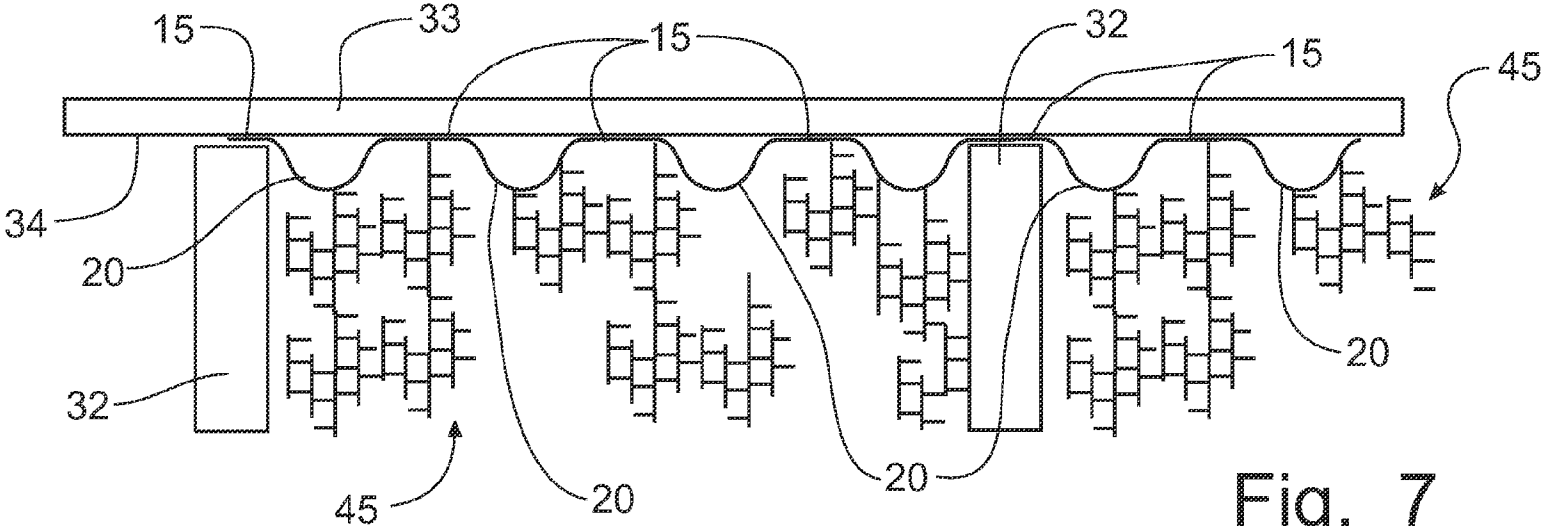
FIG. 7 is an enlarged end elevational view of a portion of the structure shown in FIG. 6.

Each longitudinally extending rib 15 is formed with a flat top surface 17 having a width of approximately one and one-half inches to mate with the nominal width of the top surface of a roof rafter 32, whether the roof rafter 32 is formed from 2×6, 2×8, or 2×10 lumber, as is best seen in FIGS. 6 and 7, except for the two end ribs 15 along each transverse edge of the baffle which are intended to span about half the rafter width to mate with an adjoining baffle 10. Each valley 20 between the longitudinally extending ribs 15 is preferably formed in a semi-circular configuration to provide strength in cross-section to resist the expansive forces of the insulation materials, such as expanding foam insulation. Thus, each valley 20 has a rounded bottom surface 22 that is spaced vertically approximately one inch from the top surface 17 of the adjacent ribs 15. Each valley 20 extends along the circular arc having a preferred radius of approximately seven-eighths of an inch from the center of the rounded bottom surface 22 through an angular deflection of approximately 68.5 degrees in each direction from the center of the bottom surface 22, measured from the tangent at the center of the rounded bottom surface 22, whereupon the valley 20 begins a reverse bend along a radius of approximately three-eighths of an inch to join with the horizontal, flat top surface 17 of the rib 15 on either side of the valley 20.

The above-described pattern is repeated on four inch intervals measured from the center of the flat top surface 17 of one rib 15 to the center of the flat top surface 17 of the next adjacent rib 15, and consequently from the center of the rounded bottom surface 22 of each valley 20 to the center of the rounded bottom surface 22 of the next adjacent valley 20. With this particular configuration of ribs 15 and valleys 20, the baffle vent 10 can also mate with any oddly spaced roof rafter 32, so long as the spacing from the next adjacent roof rafter 32 is a multiple of four inches. As an example, the end roof rafter 21 on a roof structure is not always placed at the same sixteen or twenty-four inch spacing as the remaining roof rafters 32, because the overall length of the roof is not divisible by four feet. In such situations, the end rafter 32 will typically have an end spacing of eight, twelve or twenty inches. The baffle vent 10 can easily accommodate such an odd end spacing with a rib 15 that will mate with the top surface of the end roof rafter 32.

The configuration of the end elevation of the baffle vent 10, as is best seen in FIGS. 2, 6 and 7, is such that the arched valleys 20 are supported by the adjacent ribs 15 that are pressed against the underside 34 of the roof sheeting 33 and present an arch to resist the forces exerted by the insulation that is pushing the baffle vent 10 against the underside 34 of the roof sheeting 33. The arched shape provides a strong geometric shape that is resistant to collapse. Because the flat top surfaces 17 of the ribs 15 are typically pressed against the underside 34 of the roof sheeting 33 by the forces exerted by the engaged insulation material, each longitudinally extending rib 15 can be formed with a transversely extending relief depression 19 that provide a transversely extending path for any moisture to drain from between the rib 15 and the roof sheeting 33 and for air to pass from one valley 20 to the adjacent valley 20.

Where the ribs 15 are mounted on a roof rafter 32, the pressure exerted by the fastening of the roof sheeting 33 onto the roof rafter 32 through the baffle vent 10 will flatten the small relief depression 19. The relief depressions 19 are shown in a representative manner only in FIGS. 1 and 2. The actual location and positioning of the relief depressions 19 are a matter of design choice; however, the relief depressions 19 should not be aligned across the transverse width of the baffle vent 10, which would make the handling of the baffle vent 10 more difficult as the baffle vent 10 would tend to bend across the aligned relief depressions 19.

As best seen in FIGS. 4-7, the typical roof structure is formed with ceiling joists 35 that function as attic floor joists and are oriented horizontally to support a ceiling structure 36 attached to the underside of the joists 35. The roof rafters 32 are typically connected to the ends of the ceiling joists 35 and project upwardly therefrom at a prescribed angle to meet at an apex, forming with the ceiling joists 35 a conventional triangular configuration. The roof sheeting is then fastened to the top surfaces of the roof rafters 32 to form the roof structure 30. The ceiling joists 35 and the roof rafters 32 may be supplied as a pre-assembled roof truss assembly having internal braces (not shown), or alternatively may be assembled at the construction site, and spaced at sixteen or twenty-four inch centers.

The roof rafters 32 will extend downwardly past the ceiling joists 35 to form the eaves or soffits 31, which are formed with vents 41 to allow air to flow into the soffits from the outside. The roof rafters 32 and the ceiling joists 35 typically rest on the wall plate 39. After the roof sheeting 33 is attached to the roof rafters 32, the roofing surface, usually fiberglass shingles 37, are attached to the upper side of the roof sheeting 33 to complete the construction of the roof structure. One of ordinary skill in the art will recognize that a roof vent (not shown) is usually placed at the apex of the roof to permit the movement of air from the attic 40.

Insulation 45 in the desired form is placed between and above the ceiling joists 35 to insulate the living area beneath the ceiling joists 35. The ceiling material 36 will retain the insulation in the attic 40. Preferably, the insulation 45 extends to the joinder of the roof rafters 32 and the ceiling joists 35 without extending into the soffits. The baffle vent 10 described above is positioned between the insulation 45 and the underside 34 of the roof sheeting 33, as will be described in greater detail below. Air can then flow from the outside through the vents 41 in the soffit 31 through the valleys 20 in the baffle vent 10 defining passageways through the insulation 45 barrier along the underside 34 of the roof sheeting 33 into the attic 40 above the insulation. The air can then discharge through the roof vent (not shown).

For the preferred use in manufactured housing, the baffle vent 10 is placed on top of the roof rafters 32 before the roof sheeting 33 is placed on the rafters 32. The baffle vent 10 need only extend along the roof sheeting 33 for a length that is greater than the height of the insulation 45 along the roof sheeting 33. For most insulation 45 configurations, a length of 39 inches is more than sufficient to extend into the attic 40 above the insulation 45. The baffle vent 10 formed according to the principles of the instant invention does not require fastening to the tops of the roof rafters 32 when being installed. The formed shape of the PVC film provides a gripping tension in the baffle vent 10 to retain position on the roof rafters 32 without requiring fasteners. Furthermore, the properties of the PVC film stretched over multiple roof rafters along the 8 foot transverse width of the baffle vent 10 keeps the portions of the baffle vent 10 between adjacent roof rafters 32 from sagging. Once the baffle vent has been mounted on top of the roof rafters 32, the roof sheeting 33 can then be installed on top of the baffle vent 10 and on top of the roof rafters 32 beyond the baffle vent 10. The fasteners used to attach the roof sheeting 33 to the roof rafters 32 will easily pass through the baffle vent 10 and retain the baffle vent 10 in the desired location.

Referring now to FIGS. 8 and 9, an alternative embodiment of the baffle vent 10 can be seen. By forming the material with transversely extending ridges 25 that extend across the ribs 15 and valleys 20 from one transverse end of the baffle vent 10 to the other, the baffle vent 10 acquires a substantial amount of stiffness to permit the baffle vent 10 to be more easily handled and installed. This convoluted cross-sectional shape, as is best seen in FIG. 9, establishes raised ridges 25 projecting upwardly from the flats 27 between the ridges, preferably at a height of approximately 60 mils. Accordingly, the convoluted cross-sectional shape of ridges 25 and flats 27 extending along the ribs 15 where mounted on the rafters 32 also provides for many relief depressions at the flats 27 along the length of the rafter 32 for the escape of moisture that might collect between the baffle vent 10 and the rafter 32 into the adjacent valley for discharge from the structure.

Since the insulation, particularly expanded foam insulation often utilized in manufactured housing, will push the baffle vent panel 10 upwardly against the roof sheeting 33 between the rafters 32, the longitudinally extending ribs 15 will engage the roof sheeting 33, as depicted in FIGS. 6 and 7, with the rounded valleys 20 providing the passageway for the movement of air from the soffit 31 to the roof vent. The flats 27 in the ribs 15 between the rafters 32 allow moisture to escape from between the ribs 15 and the roof sheeting 33 into the adjacent valleys 20 for escape to the roof vent. With this configuration of the baffle vent 10 with transverse ridges 25 running from one transverse edge of the baffle vent panel 10 to the other transverse edge, the baffle vent 10 is sufficiently stiff to allow for ease of handling and a quick deployment onto the roof rafters 32 during manufacture of the building, and the ridges 25 provide a contact point against the roof sheeting 33 that minimizes the direct contact between the baffle vent 10 and the roof sheeting 33, whether between the sheeting 33 and the rafter 32 or against the sheeting 33 between the rafters 32.

While PVC film is the preferred material from which the baffle vent 10 is formed through the thermal molding, vacuum forming manufacturing process, one of ordinary skill in the art will recognize that other materials may be used in the manufacture of the baffle vent 10. Sheet metals, thermoplastics, and composite materials composed of fibers impregnated with thermoplastic materials can all be used to form the vent baffle 10. Sheet metals such as galvanized steel, stainless steel, aluminum and copper can be formed into vent baffles for use in the present invention. Thermoplastic materials which can be used in the present invention in addition to PVC film are, for example, polystyrenes, acetals, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used may dependent upon the desired end use and the application conditions associated with that use, as is well known in the art.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A baffle vent for manufactured housing having roof rafters covered by roof sheeting, comprising:

a plastic film panel having first and second longitudinally spaced ends defining a length dimension of said panel and first and second transversely spaced sides terminating in first and second edges, respectively, defining a transverse width dimension of said panel, said width dimension be sufficiently large to span at least three roof rafters having a minimum transverse spacing of at least sixteen inches;

alternating flat ribs and valleys spaced uniformly and extending longitudinally from said first end to said second end, each said flat rib having a transverse width dimension substantially equal to a corresponding width dimension of said roof rafters to permit each said flat rib to rest on top of a corresponding said roof rafter when aligned therewith; and a plurality of longitudinally spaced, transversely extending depressions formed in each of said flat ribs to allow drainage for moisture collecting along said rib into adjacent valleys on opposing sides of said flat ribs.

2. The baffle vent of claim 1 wherein said ribs are spaced at four inches so that said panel will have positioned above said roof rafters so long as said roof rafters are spaced on a multiple of four inches.

3. The baffle vent of claim 2 wherein said valleys are rounded to resist collapse from an installation of insulation.

4. The baffle vent of claim 3 wherein said depressions do not transversely align across all of said ribs.

5. The baffle vent of claim 4 wherein said depressions are spaced along said longitudinal length of said ribs.

6. The baffle vent of claim 3 wherein said depressions extend from said first edge to said second edge.

7. The baffle vent of claim 6 wherein said depressions are formed into an underside surface of said baffle vent to form transversely extending reinforcements that project above said longitudinally extending ribs to contact said roof sheeting.

8. The baffle vent of claim 7 wherein said panel is placed on said roof rafters before said roof sheeting is attached to said roof rafters so that said baffle vent is located between said roof rafters and said roof sheeting.

9. The baffle vent of claim 8 wherein said reinforcements are rounded.

10. The baffle vent of claim 9 wherein each transverse edge of said panel is formed as an end rib having a transverse width approximately half of said ribs between said first and second edges.

11. A roof for manufactured housing comprising:

a plurality of transversely spaced roof rafters covered by roof sheeting;

a baffle vent panel located between said roof rafters and said roof sheeting, said panel having first and second longitudinally spaced ends defining a longitudinal length dimension of said panel and first and second transversely spaced sides terminating in first and second edges, respectively, defining a transverse width dimension of said panel;

said panel being formed with alternating ribs and valleys spaced uniformly and extending longitudinally from said first end to said second end, each said longitudinally extending rib having a generally flat configuration defining a transverse width dimension substantially equal to a corresponding width dimension of each of said roof rafters, said longitudinally extending valleys being rounded; and said panel being further formed with a plurality of transverse ridges extending from said first transverse edge to said second transverse edge such that each said longitudinally extending rib and each said longitudinally extending valley is formed with said plurality of transverse ridges that project upwardly from the longitudinally extending ribs and valleys.

12. The roof of claim 11 wherein said ribs are spaced four inches apart.

13. The roof of claim 11 wherein said ridges project above said ribs to contact said roof sheeting, leaving flat gaps along said ribs between said ridges.

14. The roof of claim 13 wherein said ridges are rounded.

15. The roof of claim 14 wherein each transverse edge of said panel is formed as an end rib having a transverse width approximately half of said ribs between said first and second edges.

16. A baffle vent for maintaining a passageway between roof rafters of a building for a flow of air from a soffit to a roof vent past insulation material installed between said roof rafters which are covered by roof sheeting, comprising:

a plastic film panel having first and second longitudinally spaced ends defining a longitudinal length dimension of said panel and first and second transversely spaced sides terminating in first and second edges, respectively, defining a transverse width dimension of said panel;

said panel being formed with alternating ribs and valleys extending longitudinally from said first end to said second end, each said rib being configured for engagement with a rafter, said ribs being transversely spaced on approximately four inch centers so that multiple ribs will be located between adjacent said roof rafters with a valley being positioned between adjacent said ribs to establish said passageway between said roof rafters; and a plurality of transverse ridges extending transversely from said first edge to said second edge and projecting upwardly from each said longitudinally extending rib and each said longitudinally extending valley, said transverse ridges being uniformly spaced along said longitudinal length dimension from said first end to said second end.

17. The baffle vent of claim 16 wherein said ridges project above said ribs to contact said roof sheeting, leaving flat gaps along said ribs between said ridges.

18. The baffle vent of claim 17 wherein said ribs and valleys alternate uniformly across said width dimension on four inch spacing, each said rib having a transverse width dimension substantially equal to a corresponding width dimension of said roof rafters.

19. The baffle vent of claim 18 wherein said panel is placed on said roof rafters before said roof sheeting is attached to said roof rafters so that said baffle vent is located between said roof rafters and said roof sheeting.

20. The baffle vent of claim 19 wherein said width dimension is sufficient to span at least three of said roof rafters with said roof rafters having a minimum sixteen inch spacing, at least two of said ribs being located between each adjacent pair of roof rafters.

* * * * *